US012807372B2

(12) United States Patent
Schütte et al.

(10) Patent No.: US 12,807,372 B2
(45) Date of Patent: Nov. 24, 2026

(54) VENTILATION DEVICE AND METHOD FOR PRODUCING SAME

(71) Applicant: HAVER & BOECKER OHG, Oelde (DE)

(72) Inventors: Volker Schütte, Oelde (DE); Torsten Everwand, Wadersloh (DE)

(73) Assignee: HAVER & BOECKER OHG, Oelde (DE)

( * ) Notice: Subject to any disclaimer, the term of this patent is extended or adjusted under 35 U.S.C. 154(b) by 163 days.

(21) Appl. No.: 18/575,495

(22) PCT Filed: Jun. 27, 2022

(86) PCT No.: PCT/EP2022/067518
§ 371 (c)(1),
(2) Date: Dec. 29, 2023

(87) PCT Pub. No.: WO2023/274929
PCT Pub. Date: Jan. 5, 2023

(65) Prior Publication Data

US 2024/0327069 A1 Oct. 3, 2024

(30) Foreign Application Priority Data

Jul. 2, 2021 (DE) ..... 102021117166.0

(51) Int. Cl.
*B65D 33/01* (2006.01)

(52) U.S. Cl.
CPC ..... *B65D 33/01* (2013.01)

(58) Field of Classification Search
CPC .... B65D 33/01; B65D 81/263; B65D 5/4295; B65D 51/1611; B65D 51/1616; B65D 90/34
(Continued)

(56) References Cited

U.S. PATENT DOCUMENTS 2,593,328 A 4/1952 Meaker
5,553,942 A * 9/1996 Domke ..... B65D 77/225 383/103
(Continued)

FOREIGN PATENT DOCUMENTS

CA 3021976 A1 4/2019
CN 107878908 A * 4/2018 ..... B65D 33/00
(Continued)

OTHER PUBLICATIONS

Machine English translation of CN-107878908-A (Year: 2025).*
(Continued)

*Primary Examiner* — Hailey K. Do
(74) *Attorney, Agent, or Firm* — Greer, Burns & Crain, Ltd

(57) ABSTRACT

A ventilation device for introduction into a bag wall of a bag and bag with a ventilation device including a dust protection layer and a fluid-tight outer layer, wherein a ventilation opening is introduced into the outer layer is disclosed. A fluid-tight spacer device is arranged between the dust protection layer and the outer layer, wherein a free cross section of flow is made available between the dust protection layer and the spacer device and a free cross section of flow is made available between the outer layer and the spacer device, and wherein the spacer device includes at least one through-opening. In the method of production, the individual layers are made available, and spacer elements are made available by impressions.

21 Claims, 4 Drawing Sheets

(58) Field of Classification Search
USPC ..... 383/101, 102, 103
See application file for complete search history.

(56) References Cited

U.S. PATENT DOCUMENTS

| | | | | |
|---|---|---|---|---|
| 6,860,301 | B2 * | 3/2005 | Schaffer | B65B 1/28 141/73 |
| 11,787,616 | B2 * | 10/2023 | Hansen | B65D 77/225 137/843 |
| 2003/0219177 | A1 * | 11/2003 | Salvaro | B65D 81/2023 383/101 |

FOREIGN PATENT DOCUMENTS

| | | | | |
|---|---|---|---|---|
| DE | 19843430 | A1 | 3/2000 | |
| DE | 10250318 | A1 | 5/2004 | |
| DE | 102004026538 | A1 | 12/2005 | |
| DE | 102005035352 | A1 | 2/2007 | |
| DE | 102007022400 | A1 | 11/2007 | |
| KR | 20200038400 | A * | 4/2020 | B65D 77/225 |

OTHER PUBLICATIONS

International Search Report and Written Opinion received for PCT/EP2022/067518, mailed Oct. 21, 2022.
Search Report received for German Application No. 102021117166.0, dated May 12, 2022.

* cited by examiner

VENTILATION DEVICE AND METHOD FOR PRODUCING SAME

FIELD OF THE INVENTION

The present invention relates to a ventilation device for introduction into at least one bag wall of a bag, comprising at least one dust protection layer and at least one fluid-tight outer layer, wherein at least one ventilation opening is provided in the outer layer. The present invention also relates to a bag with such a ventilation device, a method for producing such a ventilation device and a method for introducing such a ventilation device into the bag wall of a bag.

BACKGROUND

Bags are used for storing and transporting a wide variety of products. A wide variety of bags have also become known into which bulk goods can be filled.

One problem with filling bulk goods in particular is that air enters the bag together with the bulk goods during the filling process or that the bulk goods are even made pourable or free-flowing with air, which further increases the amount of air in the product.

Even if the air can usually be removed from the bag after the filling process using various methods and devices, depending on the product and filling machine or packaging machine, air can still remain in the bag or be trapped during sealing, which in particular impairs the shape or stackability of the filled bag.

In order to minimize this problem, aeration or ventilation systems in the bag wall has become known in the prior art. However, the problem with such ventilation systems is that air trapped in the bag should be able to escape from the bag; however, the penetration of moisture must be prevented.

Since an opening in the bag skin is required for ventilation, various systems have become known through which air can flow out of the bag, but moisture ingress is prevented.

DE 10 2005 035 352 A1, for example, implements ventilation via a special configuration of the bag seam, which is configured in the manner of a labyrinth seal. However, the disadvantage here is that the production is complex and the ventilation cannot be provided flexibly on the bag, but only in the seam region. When stacking the bags, this can lead to the ventilation no longer being possible if, e.g., another bag closes the labyrinth seal of the bag arranged below due to its weight. This ventilation requires a double layer of film over the entire length of the bag, which means an increased material requirement.

It is the object of the present invention to provide a ventilation for a bag which can be used flexibly and is resource-saving.

SUMMARY

The ventilation device according to the invention is suitable for introduction into at least one bag wall of a bag and comprises at least one dust protection layer and at least one fluid-tight outer layer, wherein at least one ventilation opening is provided in the outer layer. At least one fluid-tight outer layer is arranged between the dust protection layer and the outer layer, wherein the spacer device comprises at least one through-opening, wherein at least one free cross-section of flow is made available between the dust protection layer and the spacer device and at least one free cross-section of flow is made available between the outer layer and the spacer device, so that air can escape from the inside of the bag through the free cross-sections of flow via the ventilation opening. For this purpose, the two cross-sections of flow are connected to each other via the through-opening.

The fact that the spacer device is arranged between the dust protection layer and the outer layer means in particular that the spacer device is preferably arranged at least in sections directly adjacent to the dust protection layer or the outer layer, so that one free cross-section of flow is made available at least in sections by the spacer device and the dust protection layer or therebetween and the other free cross-section of flow is made available at least in sections by the spacer device and the outer layer or therebetween.

Depending on the configuration, the ventilation device according to the invention is designed in particular in the form of a separate so-called patch, which is preferably applied to the bag wall from the outside, wherein the ventilation device replaces in particular at least a part of the bag wall in order to vent the filled bag. In other configurations, however, the ventilation device can also be formed in combination with the existing bag wall. In this case, the bag film provides the outer layer, and the spacer device and the dust protection layer are brought into contact with the bag wall from the inside and connected thereto, thereby forming the ventilation device. The ventilation opening can then be implemented, for example, as a slit in the bag wall or outer layer.

Depending on the configuration and extent of the necessary ventilation, for example, a ventilation device or patch can be provided in the bag wall of a bag. Depending on the embodiment, multiple ventilation devices or patches may also be placed on multiple sides of the bag or in multiple bag walls, or multiple patches can also be provided in one bag wall.

The ventilation device according to the invention offers many advantages. On the one hand, sufficient or suitable ventilation of a bag can be achieved with the ventilation device according to the invention. Due to the fact that a free cross-section of flow is formed between the dust protection layer and the spacer device, air from the bag can enter this free cross-section of flow through the dust protection layer. Furthermore, the air can enter the free cross-section of flow between the spacer device of the outer layer through the through-opening, wherein the air can then be discharged to the outside through the ventilation opening.

In doing so, the ventilation device according to the invention achieves that air can pass out of and into the bag, but that no water or moisture can enter the bag. Although, depending on the ambient conditions, water vapor or high humidity can penetrate into the bag since the dust protection layer is active, for example in flow respiration, if, for example, the pressure ratios between internal pressure external pressure change due to strong temperature fluctuations and external air is drawn into the bag; however, no water runs into the bag. Air can escape through the spacer device; however, depending on the configuration of the spacer device, the capillary effect is prevented or at least reduced so that the bag contents remain dry even in the case of slight wetness.

Depending on the configuration, it can also be provided for the ventilation opening to be closed after ventilation.

Preferably, a reactivatable adhesive and/or wax dots and/or the like can be provided, which are/is pre-positioned on the spacer device and/or on the inside of the outer layer. Closing the ventilation opening can be achieved by reactivation by means of thermal radiation, thermal contact, induction and/or moisture. Depending on the configuration, the ventilation opening in the spacer device can be closed in addition to or as an option to closing the ventilation opening. As a further possibility for closing the ventilation opening, for example, wax dots, other materials that temporarily liquefy when exposed to heat such as hot glue and/or the like can also be provided on the dust protection layer, which bond with the dust protection layer during reactivation or interrupt the permeability thereof. If the dust protection layer is configured as a nonwoven fabric, for example, it then becomes saturated with wax, adhesive or the like and is thus sealed.

After sufficient ventilation, the ventilation opening can also be closed retroactively, if necessary, for example by means of a label, sticker, sticker and/or the like.

Preferably, the spacer device comprises at least one spacer element, wherein the spacer element provides at least one free cross-section of flow between the dust protection layer of the spacer device and/or at least one free cross-section of flow between the outer layer and the spacer device. By providing at least one spacer element, it is possible in particular to prevent the outer layer and the spacer device and the dust protection layer and the spacer device from lying too close together, so that a sufficient free cross-section of flow through which excess air can be discharged from the bag to the outside is always available.

Preferably, at least two spacer elements are provided, which essentially have an opposite orientation. In particular, at least one spacer element faces the outer layer and at least one spacer element faces the dust protection layer. In this manner, sufficient spacing between the outer layer and the dust protection layer and the spacer device can be ensured so that there is always sufficient air flow from the inside of the bag to the ventilation opening.

Preferably, at least sections of the spacer device are made of at least one plastic material, in particular polyethylene and/or polypropylene. Depending on the configuration, however, the spacer device can also be formed in sections or completely from other materials.

In expedient refinements, the spacer device is provided at least in sections and in particular completely by at least one polyethylene sheet. The spacer device or the base of the spacer device or the polyethylene sheet is preferably made of the same material as the bag wall or the bag, so that the entire bag including the ventilation device can be recycled together. This makes it easy to provide a spacer device made of a suitable material.

Preferably, the bag wall or the bag material, the outer layer, the spacer device and/or the dust protection layer can be made of the same material so that the bags are batchable, i.e., can be recycled or are recyclable in particular by type. In particular, it is provided that the spacer device and the dust protection layer are made of the same material as the outer layer and/or the bag wall.

In general, polyethylene (PE) and/or polypropylene (PP) can preferably be used as the base material for the bag wall or the bag material, the outer layer, the spacer device and/or the dust protection layer.

Preferably, at least one impression is introduced into the spacer device. Such an impression can preferably have any shape, for example round, square, pointed, and/or impressions with different contours or shapes can also be provided. Alternatively, instead of or in addition to an impression, an application can also be provided, for example an applied grain or another applied and/or introduced element. In doing so, it is not necessary for the spacer element to be firmly connected to the base of the spacer device or the intermediate layer.

It is particularly preferable for the spacer elements to be introduced into the spacer device with opposite orientations by impressions from different sides. This makes it possible in a simple manner to provide a sufficient distance between the individual layers via a component, thus, in this case, by means of spacer devices with different impressions.

Preferably, the dust protection layer is provided by at least one nonwoven fabric. In particular, at least one PE spunbonded fabric and/or PP spunbonded fabric is provided.

In expedient refinements, the ventilation opening is formed in a slit-like manner and/or comprises at least one slit. Depending on the configuration, the ventilation openings can also be configured to be round and in particular punched round, wherein in such a configuration, a punching from the inside to the outside is provided in particular so that the material cannot bend back into the opening, for example due to the outgoing air flow or fluid flow, and thus close it. In this case, it is particularly useful not to punch out the entire opening.

In the case of rectangular ventilation devices or ventilation devices with a rectangular shape, slits are preferred as the ventilation opening or openings, which extend in particular to the corners and/or to the lower edge. It is preferable here that the slits or openings extend to the region of a weld seam connecting the layers such that no pockets can form in which moisture can remain. This prevents moisture from escaping from the pockets into the inside of the bag when the bag is picked up, for example. Depending on the configuration, horizontal cuts or slits positioned directly at the weld seam can also be used. This also reliably prevents the accumulation of moisture.

Preferably, the dust protection layer and the spacer device and/or the outer layer and the spacer device are connected at points and/or circumferentially. In particular, this connection can be made by welding, gluing or another suitable method. In particular, it is preferable that the ventilation device is tightly connected to the bag so that, apart from the ventilation opening, an overall tight outer skin of the bag is made available.

It is particularly preferable that the outer layer is provided at least in sections by at least one plastic film, in particular by at least one polyethylene film. Depending on the configuration, any other type of film or any other suitable material can also be used.

Preferably, the connection between the dust protection layer and the spacer device and/or the outer layer and the spacer device extends in the region of the spacer element or spacer elements or the spacer elements in the outer region of the ventilation device. If, for example, multiple rows of impressions are provided as spacer elements, the connection or the weld or the adhesive seam runs along the outermost row of impressions and, in particular, even seals it in order to avoid a capillary effect.

Preferably, the outer layer is provided by at least one bag wall of a bag. In such a configuration, the dust protection layer is arranged together with the spacer device, or these two layers are arranged as a patch on the inside of the bag wall and connected thereto. As a result, the bag wall itself becomes the outer layer of the ventilation device in the region of the ventilation device. Before, during and/or after the integration of the dust protection layer and the spacer device, at least one ventilation opening is then introduced into the outer layer or the bag wall.

In advantageous configurations, the through-opening and the ventilation opening are provided at different heights in a state installed in a bag wall, wherein the ventilation opening is arranged lower than the through-opening. As a result, it can be achieved that, on the one hand, air can be discharged from the bag in a suitable manner, but also that moisture cannot run into the interior of the bag since the ventilation opening is located lower than the through-opening.

In expedient refinements, the through-opening is provided by at least one hole or opening in the spacer device.

Preferably, the through-opening is integrated into at least one spacer element. For example, in the case of a spacer element formed as an impression, the impression can be made by means of a pointed punch or the like, or with a sharpened cylindrical pin, so that the through-opening is integrated into the spacer device or into the spacer element.

Preferably, the through-opening is provided in at least one spacer element in the direction of the outer layer. In this manner, a kind of valve can be provided, whereby the through-opening is closed by the direct engagement of the outer layer on the through-opening, for example when a negative pressure is created in the bag. In this manner, the penetration of moisture into the bag can be prevented by different pressure conditions inside and outside the bag.

Preferably, at least one absorber device is provided. Such an absorber device can be introduced as additional safety, for example in the free cross-section of flow between the dust protection layer and the spacer device and/or also in the free cross-section of flow between the outer layer and the spacer device. It is conceivable to use a moisture absorber, e.g., in the form of powder, granulate or the like, so that moisture penetrating despite all precautions is absorbed by this absorber. Thus, depending on the configuration, even product protection can be achieved by absorbing moisture through the absorber.

In expedient refinements, at least one data device is provided, in particular a contactless data device. Such a data device can be provided, for example, by an RFID chip and/or another data chip. Such a data device, in particular an RFID chip, can serve in particular as copy protection, moisture sensor, storage of production data for quality control, general information or other data.

Preferably, at least one copy protection is provided. Such copy protection can be provided, for example, by printing with UV ink.

A bag according to the invention comprises at least one bag wall and at least one ventilation device, as described above, in at least one bag wall.

The bag according to the invention is particularly suitable and designed to be filled with bulk material.

The bag according to the invention also offers the advantages already described above for the ventilation device according to the invention.

Preferably, the ventilation opening is arranged at the end of the bag and/or in the edge region of the ventilation device, wherein the ventilation opening is produced by interrupting the connection or weld or adhesive bond or the like between the spacer device and the outer layer in this region.

Preferably, the ventilation device is inserted into the bag wall in such an orientation that in a predetermined orientation of the bag, the at least one ventilation opening is located lower than the through-opening in the spacer device. In this manner, no water can run into the inside of the bag, even if a small amount of water should get into the patch. Care must be taken here to ensure that the orientation is adapted such that the ventilation device also functions properly later on in the intended use of the bag. During the production of the bag, particular attention can be paid to how the bags are stacked later on or whether the ventilation of the bag is provided in a resting position after the filling process, in which the bag is not lying down, for example, but standing.

Particularly preferably, the ventilation device is welded and/or glued into the bag wall. In doing so, the ventilation device or the patch is placed on the bag or a corresponding opening in the bag wall, in particular from the outside, and connected to the bag wall. Alternatively and preferably, the bag wall can also be used as an outer layer. In this case, the spacer device and the dust protection layer are connected to or arranged on the inside of the outer layer.

In advantageous configurations, at least one weld seam and/or adhesive seam is arranged in the region of at least one spacer element. In this manner, a capillary effect can be effectively prevented since the film layers are prevented from resting directly on each other at the edge, which could draw moisture in the direction of the through-opening.

The method according to the invention is suitable for producing a ventilation device as described above. The method comprises the following steps in a suitable number and sequence: at least one polyethylene film or other suitable base for the spacer device is made available. At least one dust protection layer is made available. A predetermined pattern of impressions is introduced into the spacer device from one side, in particular by means of at least one embossing device, such as an embossing roller or an embossing die. At least one pattern of impressions is introduced into the spacer device from the other side by at least one embossing device, such as an embossing roller or an embossing die. In particular, the patterns can differ and/or are preferably offset from one another. At the same time, and/or afterwards and/or also beforehand, at least one through-opening is introduced into the spacer device. Optionally, at least one outer layer is made available and the spacer device and/or the dust protection layer and/or the outer layer are connected to each other.

As already described above, a separate outer layer can be provided or the bag wall can be used as the outer layer.

Preferably, a complete patch with an outer layer or a prefabricated patch comprising the dust protection layer and the spacer device can thus be provided.

It is particularly preferable that the insertion of the spacer elements or the impressions takes place at least partially in parallel, for example by combing or meshing the two embossing devices.

Optionally, at least one ventilation opening is introduced into the outer layer directly before or after integration into the bag. If the ventilation opening is arranged at the end of the sack or at the end of the patch, interrupting the weld seam in the region of the ventilation device can be provided in the region between the spacer device and the outer layer.

The method according to the invention also offers the advantages already described above.

Preferably, the through-opening is introduced into the spacer device by means of an embossing roller. For example, it is possible to introduce only the through-opening or, at the same time, also a spacer element into the spacer device. In particular, the same embossing roller is used for the spacer elements and the through-opening.

Another method according to the invention is suitable for introducing at least one prefabricated ventilation device into at least one bag wall of a bag, wherein at least one ventilation device, as described above, is at least partially produced and/or provided, is arranged on a bag wall, and tightly connected thereto.

The method according to the invention offers the advantages already described above.

The ventilation device or the patch is preferably unwound from a roll, for example, and one patch at a time is cut off and fed by means of a suitable transport means or the like to the inside of the outer layer and connected thereto.

Depending on the configuration, the prefabricated patch can preferably also be applied to the outside of the outer layer or connected thereto.

In advantageous refinements, the ventilation device is produced inline, preferably parallel to the bag production.

Depending on the configuration, the original bag wall can be removed before the integration, during the integration or even after the integration of a prefabricated patch or a prefabricated ventilation device.

If the ventilation device is used in combination with the original bag wall as an outer layer, at least one ventilation opening can be introduced into the original bag wall before the integration, during the integration or even after the integration, depending on the configuration.

BRIEF DESCRIPTION OF THE DRAWINGS

Further advantages and features of the present invention are apparent from the exemplary embodiment, which is explained below with reference to the accompanying figures.

In the figures.

DETAILED DESCRIPTION

Figure 1:
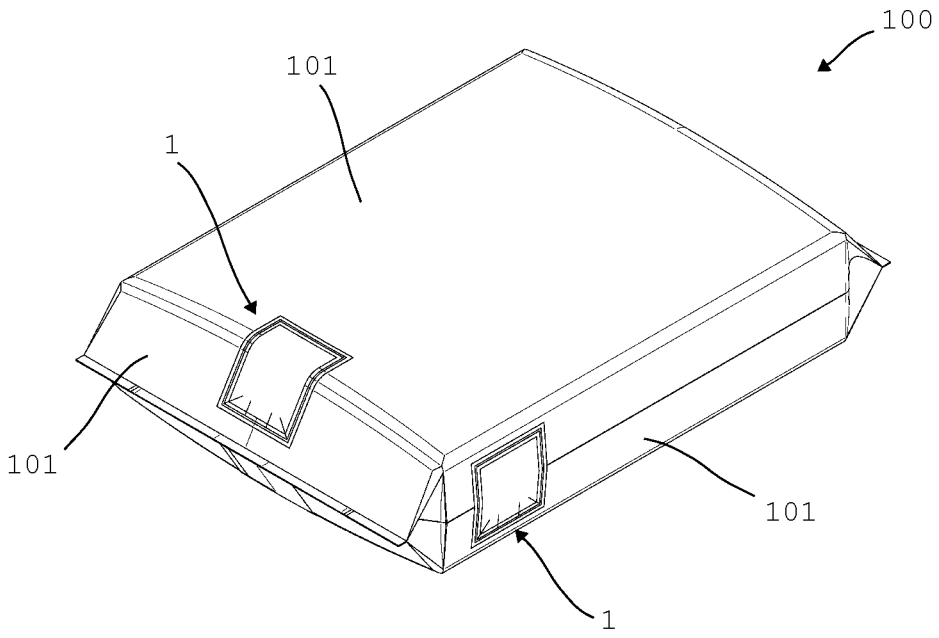
FIG. 1 shows a purely schematic illustration of an exemplary embodiment of a bag according to the invention with ventilation devices according to the invention in a perspective view.

FIG. 1 shows a purely schematic view of a bag 100 according to the invention, which here is a film bag comprising multiple bag walls 101. Various products can be filled into this bag 100. In the exemplary embodiment shown, bulk material is filled into the bag.

In order to remove air from the bag 100 so that it can be easily stored or stacked later or is given a defined shape, multiple ventilation devices 1 according to the invention are integrated into different side walls 101 of the bag 100 in the exemplary embodiment shown. Depending on the configuration, only one ventilation device 1 may also be sufficient.

The ventilation device 1 shown here has been prefabricated as a so-called patch and placed on the outside of the bag wall 101 and connected thereto. For this purpose, in the exemplary embodiment shown here, a corresponding opening has previously been introduced into the bag wall.

Figure 2:
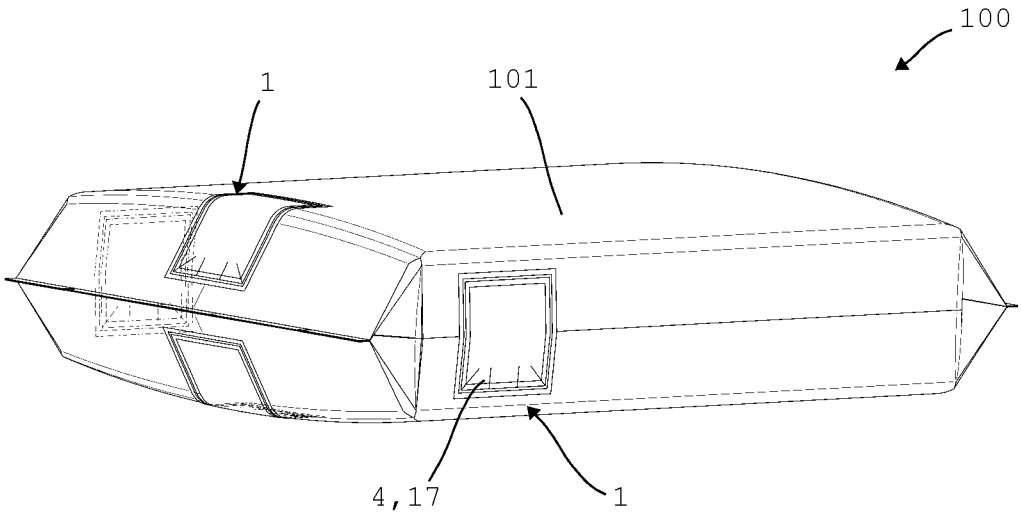
FIG. 2 shows a purely schematic illustration of an embodiment of a bag according to the invention with ventilation devices according to the invention in a perspective view.

FIG. 2 illustrates another exemplary embodiment of a bag 100 according to the invention with ventilation devices 1 according to the invention. These ventilation devices 1, also called patch, comprise an air channel system which allows excess air to escape from the bag without allowing moisture to penetrate or run into the bag.

Figure 3:
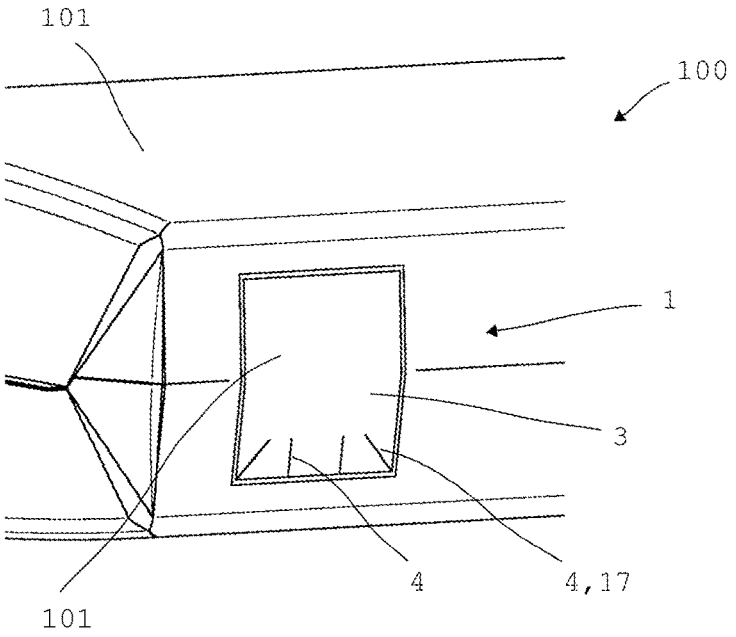
FIG. 3 shows a purely schematic illustration of a section of an exemplary embodiment of a bag according to the invention with ventilation devices according to the invention in a perspective view.

FIG. 3 is purely schematically a perspective view of a section of a bag 100 according to the invention with a ventilation device 1 according to the invention.

Here, the outer layer 3 of the ventilation device is provided by the bag wall 101, into which the ventilation openings 4 are introduced in a slit-like manner.

In such a configuration, for example, the spacer device 5 and the dust protection layer can be supplied individually, together, or prefabricated as a patch to the inside of the outer layer 3 or the bag wall 101 and connected thereto.

Figure 4:
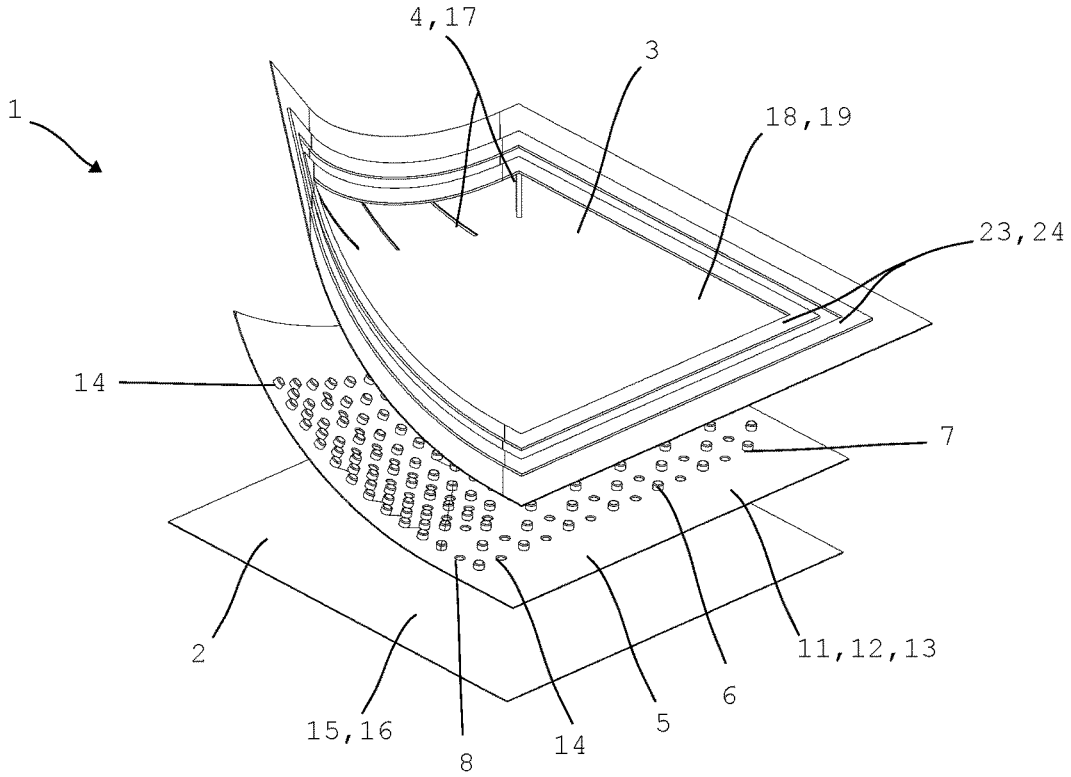
FIG. 4 shows a purely schematic illustration of an exemplary embodiment of a ventilation device according to the invention in an exploded view.

FIG. 4 illustrates a purely schematic exploded view of the structure of the patch or of a ventilation device 1 according to the invention. The ventilation device 1 according to the invention comprises a dust protection layer 2, which is in direct contact with the product introduced into the bag and prevents any product from entering the ventilation device 1 or from exiting the bag 100. The dust protection layer 2 is provided here by a nonwoven fabric 15 or a PE spunbonded fabric 16.

In the exemplary embodiment shown, a spacer device 5 is arranged on the dust protection layer 2 as an intermediate layer, which in the exemplary embodiment shown here consists of plastics 11 or polyethylene 12 and is provided here by a polyethylene sheet 13. This polyethylene sheet 13 or the spacer device 5 provides a basically waterproof intermediate layer, so that any water that may penetrate the patch cannot get into the dust protection layer 2 or the bag 100.

A plastic film 18 or polyethylene film 19, which corresponds to the material of the bag wall 1, is used here as the final layer or outer layer 3 above the spacer device 5. Depending on the configuration, it is useful to use the same material for each layer, i.e., also for the spacer device 5 and the dust protection layer 2 of the ventilation device 1 or the patch, which is also used as the outer skin or bag wall 101 for the bag 100. In this manner, the entire bag with the ventilation device 1 can be recycled together.

In the exemplary embodiment illustrated here, the spacer device 5 comprises multiple spacer elements 7, 8 which protrude from the spacer device 5 in different directions.

In the exemplary embodiment shown here, the spacer elements 7, 8 are produced integrally with the spacer device 5 or, in the exemplary embodiment shown here, with the polyethylene sheet 13.

For this purpose, impressions 15 are introduced from both sides of the polyethylene sheet 13, in each case in the direction of the dust protection layer 2 and the outer layer 3, so that the spacer elements 7, 8 keep the dust protection layer 2 and the outer layer 3 at a distance from the spacer device 5. As a result, a free cross-section of flow 9 is created between the dust protection layer 2 and the spacer device 5 and a free cross-section of flow 10 is created between the spacer device 5 and the outer layer 3.

In order to be able to integrate the patch or the ventilation device 1 into a bag 100 and, in addition, to achieve a tight connection with the bag 100 and also a fluid-tight seal of the bag 100, the individual layers are connected to each other, wherein gluing, welding and/or any other tight connecting of the individual layers is advantageous here in particular.

Slits 17, for example, are provided in the outer layer 3 as ventilation openings 4, which slits extend here to the corners or to the edges so that no formation of pockets can occur.

FIG. 4 illustrates a purely schematic sectional view from the side of the air routing or ventilation through the ventilation device 1. The arrows inside the bag 100 or below the dust protection layer 2 indicate the air that penetrates through the dust protection layer 2 or, in this case, the PE spunbonded fabric 16 into the free cross-section of flow 9 between the dust protection layer 2 and the spacer device 5.

Through-openings 9 are provided in the spacer device 5, through which the escaping air can pass from the first free cross-section of flow 9 into the second free cross-section of flow 10 between the outer layer 3 and the spacer device 5. Here, the spacer elements 7, 8 prevent the outer layer 3 or the dust protection layer 2 from resting too close against the spacer device 5, which could reduce or, in the worst case, prevent venting of the bag 100.

As already mentioned, the illustration is purely schematic. As a result, the outer layer 3 and the dust protection layer 2 do not rest against the spacer elements 7, 8.

In the exemplary embodiment shown here, a ventilation opening 4 is provided in the lower region of the patch or the ventilation device 1 in the outer layer 3, through which the air can leave the bag 100 or the ventilation device 1.

In the installed state or the intended form of storage of the bag 100, the ventilation opening 4 in the exemplary embodiment shown is located lower than the through-opening 6 in the spacer device 5, so that water or moisture, which could get through the ventilation opening 4 into the region between the outer layer 3 and the spacer device 5, cannot get through the through-opening 6 towards the dust protection layer 2 and thus into the inside of the bag.

Figure 5:
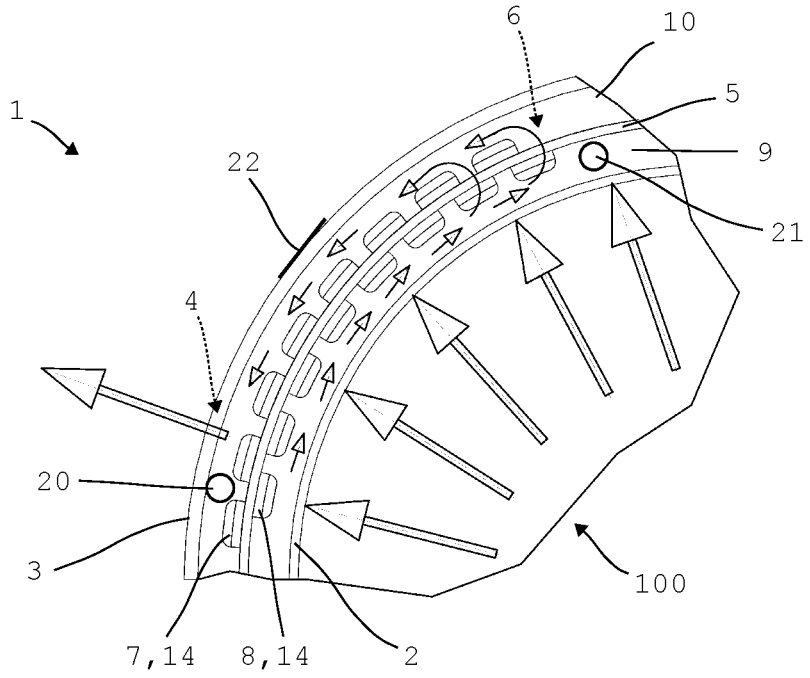
FIG. 5 shows a purely schematic illustration of an exemplary embodiment of a bag according to the invention with a region of a ventilation device according to the invention in a sectional view from the side.

Furthermore, it is indicated purely schematically in FIG. 5 that further different components can be provided in the patch or the ventilation device 1. For example, an absorber device 20 can also be provided, which absorbs penetrating moisture and thus prevents the product in the bag 100 from becoming soaked. In the exemplary embodiment shown, this absorber device 20 is provided in the intermediate layer or in the free cross-section of flow 10 between the outer layer 3 and the spacer device 5. However, the absorber device 20 can also be arranged at a different location. Multiple absorber devices 20 can also be provided.

Furthermore, it is illustrated that a data device 21 can also be provided in the ventilation device 1. A contactless data device is particularly advantageous. Such a data device can be provided, for example, by an RFID chip and/or another data chip. Such a data device 21, in particular an RFID chip, can serve in particular as copy protection, moisture sensor, storage of production data for quality control, general information or other data. In the exemplary embodiment shown here, this chip is arranged in the free cross-section of flow 9 between the dust protection layer 2 and the outer layer 3. Such a data device 21 can fulfill various functions.

It is further indicated that, for example, copy protection can be provided on the outer layer 3 on the ventilation device 1. Such copy protection can be provided, for example, by UV ink or the like.

Figure 6:
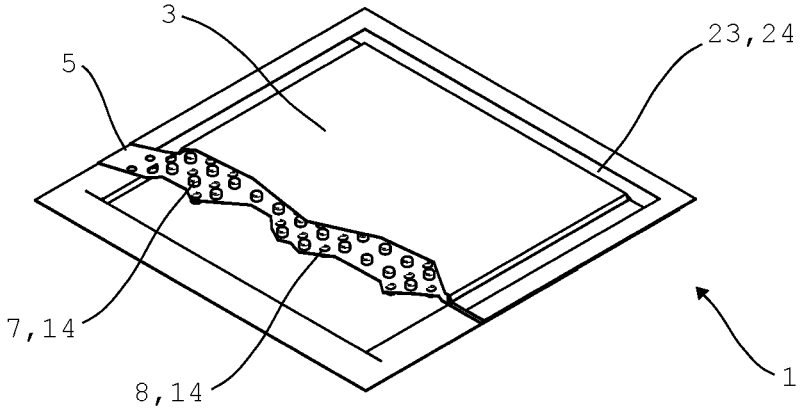
FIG. 6 shows a purely schematic illustration of an exemplary embodiment of a ventilation device according to the invention in a perspective view.

FIG. 6 shows a purely schematic exemplary embodiment of a patch or a ventilation device 1 in a perspective top view.

It can be seen that the individual layers or the dust protection layer 2 and the outer layer 3 are connected here to the spacer device 5 located therebetween via circumferential weld seams 23 or, depending on the configuration, adhesive seams 24.

A region of the outer layer 3 is airbrushed out here to allow a view of the spacer device 5 with the spacer elements 7, 8 provided here as impressions 14.

It can be seen here that the spacer elements 7, 8 or, in this case, the rows of impressions 14 are extended close to the edge of the ventilation device 1 and that the weld seams 23 or, depending on the configuration, adhesive seams 24 also extend beyond the impression 14 and seal it. As a result, it is achieved that a capillary effect is also prevented in the edge region so that moisture penetrating between the outer layer 3 and the spacer device 5, for example through the ventilation opening 4, cannot be drawn upwards in the direction of the through-opening 6. This effectively prevents moisture from penetrating into the bag 100.

Figure 7:
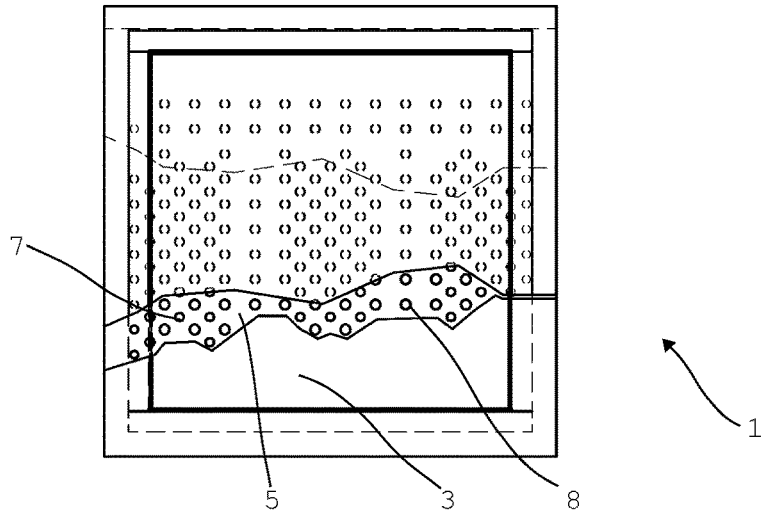
FIG. 7 shows a purely schematic illustration of an exemplary embodiment of a ventilation device according to the invention in a top view.

In FIG. 7, the exemplary embodiment according to FIG. 6 is illustrated in a top view, wherein here too, the outer layer 3 is partially airbrushed out. Here, too, it can be seen that the weld seams 23 or adhesive seams 24 run over the outer rows of spacer elements 7, 8 or impressions 14 in order to also prevent a capillary effect in the edge region since in this manner, the individual layers or film layers are also kept at a distance in the edge region.

Figure 8:
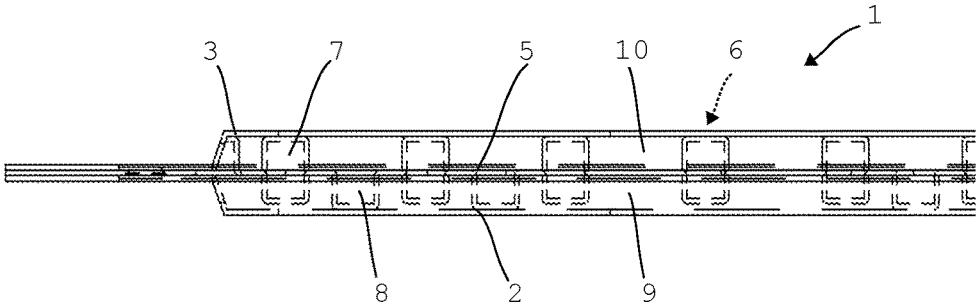
FIG. 8 shows a purely schematic illustration of an exemplary embodiment of a ventilation device according to the invention in a sectional view from the side.

FIG. 8 shows a purely schematic exemplary embodiment of a ventilation device 1 according to the invention in a sectional view from the side.

It can also be seen here that the spacer device 5 or spacer elements 7, 8 form free cross-sections of flow 9, 10 between the dust protection layer 2 and the spacer device 5 or the spacer device 5 and the outer layer 3 through which air can escape from the bag 100 or ventilation or aeration can be achieved.

Furthermore, it is shown here that the through-opening is integrated in spacer elements 7 in the direction of the outer layer 3.

Depending on the configuration, this can lead in particular to the creation of a kind of valve. If air escapes through the through-opening 5 to the outside, the outer layer 3 is pushed slightly away from the through-opening, thereby unblocking it.

If a negative pressure is created in the bag, the outer layer is sucked towards the through-opening 5, causing it to be closed by the outer layer 3.

Figure 9:
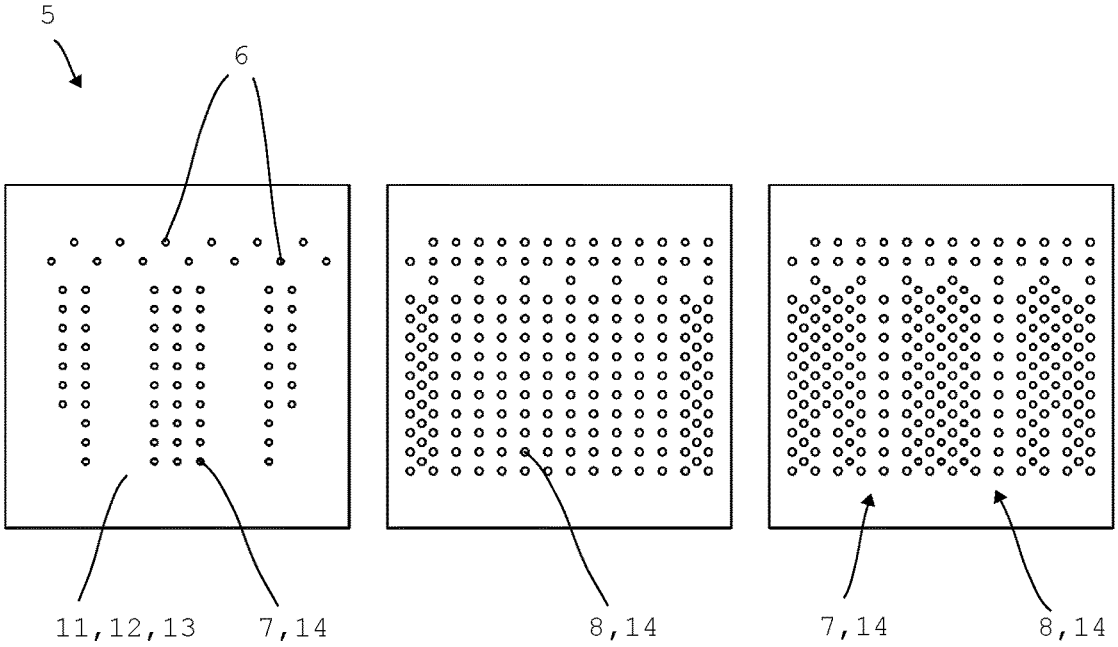
FIG. 9 shows three purely schematic illustrations of a spacer device with different impressions.

FIG. 9 shows three purely schematic illustrations of a spacer device 5 of a ventilation device 1 according to the invention.

Here, the spacer device 5 is provided by a polyethylene sheet 13. It is indicated here that the first spacer elements 7 are introduced into the spacer device 5 from one side by impressions 14 (left image).

The middle view shows that a different embossing pattern is introduced into the spacer device from the other side. For the sake of clarity, the individual pattern is shown here.

The right image shows a superimposition of the two embossing patterns when the impressions 14 are introduced into the spacer device 5 from both sides.

In the left image, it is indicated that the through-openings 6 in the exemplary embodiment shown are provided by impressions 14 or spacer elements 7. These special impressions 14 are produced using sharpened cylindrical pins, for example.

Thus, by impressing certain patterns into both sides of the spacer device 5, it can be achieved that spacer elements 7, 8 are formed integrally with the spacer device 5, wherein the spacer elements 7, 8 extend in different directions.

It is particularly preferable that the spacer elements are created by two parallel embossing devices, for example by intermeshing embossing rollers which are matched to each other accordingly.

While particular embodiments of the present ventilation device and method for producing same have been described herein, it will be appreciated by those skilled in the art that changes and modifications may be made thereto without departing from the invention in its broader aspects and as set forth in the following claims.

REFERENCE LIST

1 ventilation device
2 dust protection layer
3 outer layer
4 ventilation opening
5 spacer device
6 through-opening
7 spacer element
8 spacer element
9 free cross-section of flow
10 free cross-section of flow
11 plastics
12 polyethylene
13 polyethylene sheet
14 impression
15 nonwoven fabric
16 PE spunbonded fabric
17 slit
18 plastic film
19 polyethylene film
20 absorber device
21 data device
22 copy protection
23 weld seam
24 adhesive seam
100 bag
101 bag wall

The invention claimed is:

1. A ventilation device for insertion into at least one bag wall of a bag, comprising: at least one dust protection layer and at least one fluid-tight outer layer; wherein at least one ventilation opening is introduced into the at least one fluid-tight outer layer;

at least one fluid-tight spacer device is arranged between the at least one dust protection layer and the at least one fluid-tight outer layer; wherein at least one free cross-section of flow is made available between the at least one dust protection layer and the at least one fluid-tight spacer device and at least one free cross-section of flow is made available between the at least one fluid-tight outer layer and the at least one fluid-tight spacer device; and wherein the at least one fluid-tight spacer device comprises at least one through-opening;

wherein the at least one fluid-tight spacer device comprises at least one spacer element, wherein the at least one free cross-section of flow between the at least one dust protection layer and each of said at least one fluid-tight spacer device is made available by the at least one spacer element; and wherein the at least one through-opening and the at least one ventilation opening are provided at different heights in a state installed in a bag wall, wherein each said at least one ventilation opening is arranged lower than the at least one through-opening.

2. The ventilation device according to claim 1, wherein the at least one fluid-tight spacer device consists at least in sections of at least one plastic.

3. The ventilation device according to claim 1, wherein the at least one fluid-tight spacer device is made available by at least one polyethylene sheet and/or at least one polypropylene sheet.

4. The ventilation device according to claim 1, wherein the at least one dust protection layer is made available by at least one nonwoven fabric.

5. The ventilation device according to claim 1, wherein the at least one ventilation opening is formed in a slitted manner and/or comprises at least one slit.

6. The ventilation device according to claim 1, wherein the at least one fluid-tight outer layer is made available at least in sections by a plastic film.

7. The ventilation device according to claim 1, wherein the at least one fluid-tight outer layer is made available by at least one bag wall of a bag.

8. The ventilation device according to claim 1, wherein the at least one through-opening is made available by at least one hole in the at least one fluid-tight spacer device.

9. The ventilation device according to claim 1, wherein the at least one through-opening is integrated in the at least one spacer element.

10. The ventilation device according to claim 1, wherein the at least one through-opening is provided in at the least one spacer element in a direction of the at least one fluid-tight outer layer.

11. The ventilation device according to claim 1, wherein the at least one dust protection layer and the at least one fluid-tight spacer device and/or the at least one fluid-tight outer layer and the at least one fluid-tight spacer device are connected to each other at points and/or circumferentially.

12. The ventilation device according to claim 11, wherein the connection between the at least one dust protection layer and the at least one fluid-tight spacer device and/or the at least one fluid-tight outer layer and the at least one fluid-tight spacer device extends in a region of the at least one spacer element.

13. The ventilation device according to claim 1, wherein the free cross-section of flow between the at least one fluid-tight outer layer and the at least one fluid-tight spacer device is made available by the at least one spacer element.

14. The ventilation device according to the claim 13, wherein at least two spacer elements are provided in the at least one fluid-tight spacer device, which essentially have an opposite orientation.

15. The ventilation device according to claim 13, wherein the at least one spacer element is introduced into the at least one fluid-tight spacer device by at least one impression.

16. The ventilation device according to claim 15, wherein the at least one spacer element is introduced into the at least one fluid-tight spacer device with opposite orientation by impressions from different sides.

17. A bag with at least one bag wall for use with at least one ventilation device according to claim 1, wherein the at least one ventilation device is introduced into the at least one bag wall according to the orientation of the at least one ventilation opening and the at least one through-opening in the at least one fluid-tight spacer device.

18. The bag according to claim 17, wherein the outer layer is made available by the at least one bag wall.

19. The bag according to claim 17, wherein the at least one ventilation opening is arranged at an end of the bag or in an edge region of the at least one ventilation device and is produced by interrupting the connection between the at least one fluid-tight spacer device and the at least one fluid-tight outer layer.

20. The bag according to claim 17, wherein the at least one ventilation device is welded and/or glued into the at least one bag wall.

21. The bag according to claim 20, wherein a weld seam and/or adhesive seam is arranged in a region of the at least one fluid-tight spacer element.

* * * * *